US008875649B2

(12) United States Patent
Haas

(10) Patent No.: US 8,875,649 B2
(45) Date of Patent: Nov. 4, 2014

(54) APPARATUS FOR DUSTING PRINTED SHEETS WITH POWDER

(75) Inventor: Claudius Haas, Steinach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 582 days.

(21) Appl. No.: 13/048,189

(22) Filed: Mar. 15, 2011

(65) Prior Publication Data

US 2011/0220014 A1 Sep. 15, 2011

(30) Foreign Application Priority Data

Mar. 15, 2010 (DE) ..... 10 2010 011 445

(51) Int. Cl.

| | |
|---|---|
| ***B05C 19/04*** | (2006.01) |
| ***B05C 19/02*** | (2006.01) |
| ***B05C 19/06*** | (2006.01) |
| ***B05B 15/04*** | (2006.01) |
| ***B05B 7/14*** | (2006.01) |
| ***B41F 23/06*** | (2006.01) |
| *B41M 7/02* | (2006.01) |

(52) U.S. Cl.

CPC ..... *B05B 7/1486* (2013.01); *B05B 15/0412* (2013.01); *B05C 19/02* (2013.01); *B41M 7/02* (2013.01); *B05B 7/1468* (2013.01); *B05C 19/04* (2013.01); *B05C 19/06* (2013.01); *B41F 23/06* (2013.01); *B05B 15/0437* (2013.01)

USPC ..... 118/309; 118/312; 118/46; 118/308; 118/300

(58) Field of Classification Search

None

See application file for complete search history.

(56) References Cited

U.S. PATENT DOCUMENTS

| | | | | |
|---|---|---|---|---|
| 5,727,472 | A * | 3/1998 | Burgio | 101/487 |
| 6,085,654 | A * | 7/2000 | Gunschera et al. | 101/424.2 |
| 7,942,096 | B2 | 5/2011 | Blaser et al. | |
| 8,166,908 | B2 | 5/2012 | Mauchle et al. | |

FOREIGN PATENT DOCUMENTS

| | | | |
|---|---|---|---|
| CN | 101028617 | A | 9/2007 |
| CN | 101330982 | A | 12/2008 |
| DE | 19643747 | A | 4/1998 |
| DE | 197 07 157 | A1 | 8/1998 |
| DE | 199 01 245 | A1 | 8/1999 |
| DE | 10 2008 009 288 | A1 | 8/2009 |
| JP | 2006224073 | A | 8/2006 |

OTHER PUBLICATIONS

German Patent and Trademark Office Search Report, dated Jul. 12, 2010.

* cited by examiner

*Primary Examiner* — Dah-Wei D Yuan

*Assistant Examiner* — Jethro Pence

(74) *Attorney, Agent, or Firm* — Laurence A. Greenberg; Werner H. Stemer; Ralph E. Locher

(57) ABSTRACT

An apparatus for dusting printed sheets with powder contains at least one powder nozzle, an actuating element which is mounted such that it can be adjusted into a position, in which the actuating element is situated in the jet path of the powder nozzle and the powder bounces off the actuating element, and an extraction device for extracting the powder which has bounced off the actuating element. An air-conducting connection exists permanently between the powder nozzle and the surroundings of the apparatus.

8 Claims, 3 Drawing Sheets

APPARATUS FOR DUSTING PRINTED SHEETS WITH POWDER

CROSS-REFERENCE TO RELATED APPLICATION

This application claims the priority, under 35 U.S.C. §119, of German application DE 10 2010 011 445.6, filed Mar. 15, 2010; the prior application is herewith incorporated by reference in its entirety.

BACKGROUND OF THE INVENTION

Field of the Invention

The present invention relates to an apparatus for dusting printed sheets with powder, containing at least one powder nozzle, an actuating element which is mounted such that it can be adjusted into a position, in which the actuating element is situated in the jet path of the powder nozzle and the powder bounces off the actuating element, and an extraction device for extracting the powder which has bounced off the actuating element.

A requirement made of dusting apparatuses is that the powder is sprayed only onto the sheets and not into the gaps between sheets which follow one another. Apparatuses with corresponding powder synchronization have therefore been developed.

A further requirement has resulted in this context: the powder synchronization is to be exact even at high printing speeds.

In order to meet this requirement, published non-prosecuted German patent application DE 199 01 245 A1 (corresponding to U.S. Pat. No. 6,085,654) proposes an apparatus, the powder gas generator of which uninterruptedly produces a gas stream which is loaded with powder. Here, the synchronization is no longer brought about by the powder gas generator, but rather by a closure element. The closure element synchronously closes an outlet opening of a housing, in which a powder nozzle is arranged. When the closure element opens the outlet opening, the powder jet escapes from the housing through the outlet opening. When the closure element closes the outlet opening, the powder from the powder nozzle bounces off the closure element. The powder which has bounced off is sucked out of the housing by an extraction device. When the outlet opening is closed by the closure element, there is no air-conducting connection between the powder nozzle and the surroundings of the apparatus. Air pressure equalization is therefore not possible and pressure surges occur. These damaging feedback effects can act via the powder nozzle and the feed line system connected to the latter as far as into the powder gas generator and disrupt the uniformity of the powder gas production.

Published, non-prosecuted German patent application DE 197 07 157 A1 describes a further dusting apparatus, in which the above-described problem is likewise not solved. It is also the case in this apparatus that the air-conducting connection between the powder nozzle and the surroundings is interrupted when the housing is closed by the closure element.

SUMMARY OF THE INVENTION

It is accordingly an object of the invention to provide an apparatus for dusting printed sheets with powder which overcome the above-mentioned disadvantages of the prior art devices of this general type, which operates with exact powder synchronization even at high printing speeds.

The apparatus according to the invention for dusting printed sheets with powder contains at least one powder nozzle, an actuating element which is mounted such that it can be adjusted into a position, in which the actuating element is situated in the jet path of the powder nozzle and the powder bounces off the actuating element, and an extraction device for extracting the powder which has bounced off the actuating element. The apparatus is distinguished by the fact that an air-conducting connection exists permanently between the powder nozzle and the surroundings of the apparatus.

One advantage of the air-conducting connection is that it makes air pressure equalization possible. As a result, damaging feedback effects are avoided and the uniformity of the powder gas production is ensured. This advantage exists even at very high printing speeds and a correspondingly high powder synchronization frequency.

In one development, the apparatus has a housing which has at least one outlet opening and one closure element for closing the outlet opening, the actuating element being formed by the closure element. Here, if the outlet opening is not closed, the powder nozzle sprays the powder through the outlet opening and, if the outlet opening is closed, the air-conducting connection exists between the powder nozzle and the surroundings of the apparatus.

In a further development, the housing has a further opening, through which the air-conducting connection exists between the powder nozzle and the surroundings of the apparatus.

In a further development, the outlet opening is situated on the front side of the housing, which front side faces the printed sheet to be dusted, and the further opening is situated on the rear side of the housing.

In a further development, the powder nozzle is arranged together with further powder nozzles in a nozzle row, and the closure element is a common closure element which extends over all the powder nozzles of the nozzle row.

In a further development, an opening of the extraction device is situated in a side wall of the housing. The opening can be the opening of a hose or pipe which is connected to the housing on the side wall.

In a further development, the apparatus has a deflection element. The deflection element serves to deflect a powder air jet which is ejected out of the powder nozzle toward the extraction device. The deflection element is identical to the abovementioned actuating element.

In a further development, the extraction device sucks continuously with a suction force during printing operation.

In a further development, the suction force is firstly so strong that the powder which is deflected when the deflection element is situated in the position is sucked in by the extraction device, and secondly the suction force is so weak that the powder jet which is sprayed to the printed sheet to be dusted when the deflection element is situated out of the position is scarcely deflected in the transverse direction by the extraction device.

A printing press which is equipped with the apparatus according to the invention or an apparatus which is configured according to one of the developments also belongs to the invention.

Other features which are considered as characteristic for the invention are set forth in the appended claims.

Although the invention is illustrated and described herein as embodied in an apparatus for dusting printed sheets with powder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In FIGS. 1 to 8, elements and components which correspond to one another are denoted by the same designations.

FIGS. 1 to 8 show details of a printing press 1 for printing on sheets, which printing takes place using lithographic offset printing. The printing press 1 contains a sheet delivery; a constituent part of the printing press 1 is the apparatus shown in the detail for dusting printed sheets 2.

Figure 1:
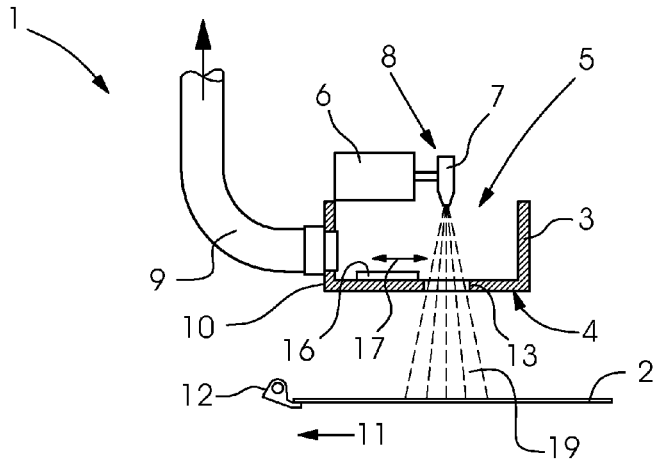
FIGS. 1 to 3 are illustrations showing a first exemplary embodiment having a common actuating element for a plurality of outlet openings of a housing according to the invention.

FIG. 1 shows the apparatus while the powder is being sprayed onto the printed sheet 2. The apparatus contains a box-shaped housing 3 which has a front side 4 which faces the printed sheet 2 and a rear side 5 which faces away from the printed sheet 2. A spray device 6 with powder nozzles 7 which are arranged in a nozzle row 8 is arranged in the housing 3 or above the housing 3. The nozzle row 8 extends over the width of the printed sheet 2 and therefore perpendicularly with respect to the plane of the drawing of FIG. 1.

An extraction device 9 which opens in a side wall 10 of the housing 3 is connected to the housing 3. The side wall 10 extends transversely with respect to a transport direction 11 of the printed sheet 2 which is transported past the dusting apparatus by a gripper bar 12 of the sheet delivery. The rear side 5 of the housing 3 is not closed, that is to say the housing 3 has no cover.

Figure 2:
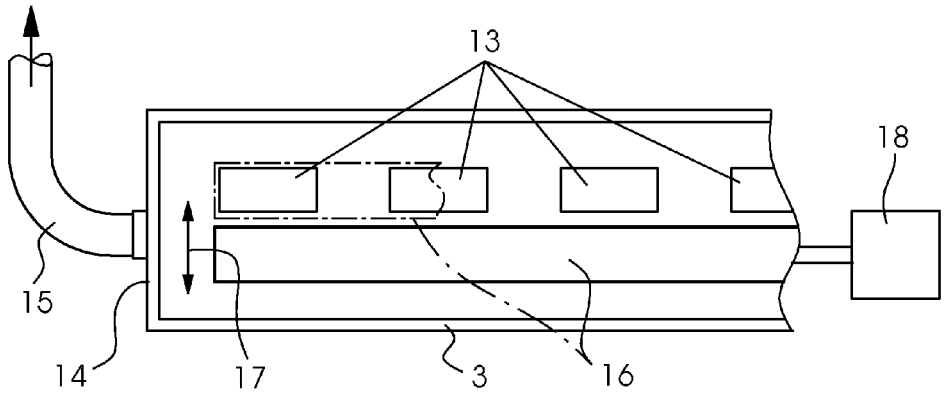

FIG. 2 shows a plan view from above of the apparatus, the spray device 6 not also being shown for reason of improved clarity. A row of outlet openings 13 which are aligned in each case with another one of the powder nozzles 7 are let into a base of the housing 3, which base forms the front side 4. The mean spacing of outlet opening 13 from adjacent outlet opening 13 is therefore the same as the mean spacing from powder nozzle 7 to adjacent powder nozzle 7.

Further extraction devices 15 open into side walls 14 of the housing 3 which are parallel with the transport direction 11; the side walls 14 are a side wall 14 which lies on the drive side of the printing press 1 and a side wall 14 which lies on the operating side. Only one of the side walls 14 and one of the extraction devices 15 are shown in the drawing. The extraction devices 15 can be connected together with the central extraction device 9 to a common vacuum generator and can be loaded permanently with vacuum by the latter during printing operation.

An actuating element 16 is arranged in the housing 3, which actuating element 16 performs a to and fro movement 17 synchronously with the delivery cycle of the printed sheets 2 which follow one another, in order to cover the outlet openings 13 periodically and as a result to close them completely. The to and fro movement 17 is a linear movement. The actuating element 16 acts as a common closure element for the outlet openings 13. A drive device 18 for driving the to and fro movement of the actuating element 16 is shown only diagrammatically.

FIGS. 1 and 2 show the actuating element 16 in a position in which it is withdrawn from the outlet openings 13. In this position, powder air jets 19 which are discharged by the powder nozzles 7 can pass through the housing 3 in an unimpeded manner. The powder air jets 19 are free jets and pass in each case one outlet opening 13 before they strike the printed sheet 2 which is situated in a position opposite the dusting apparatus.

Figure 3:
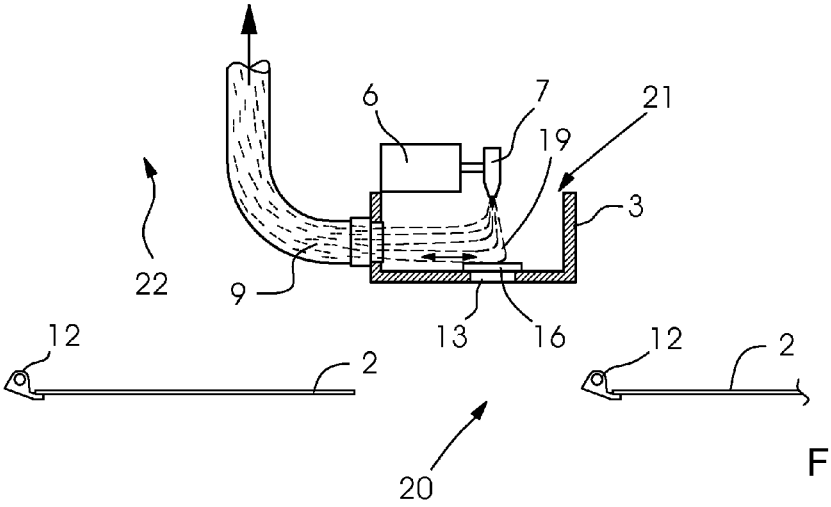

FIG. 3 shows the other of the two positions, into which the actuating element 16 is moved alternately by a drive device 18. In this other position, the actuating element 16 closes the outlet openings 13, with the result that no powder air jet 19 can escape from the housing 3 through the outlet openings 13. This prevents powder from being sprayed into a gap 20 between two printed sheets 2 which follow one another. The powder air jets 19 strike the actuating element 16 and in the process form a powder mist which is sucked away by the extraction devices 9, 15. The powder nozzles 7 can therefore spray or blast permanently and uniformly during printing operation and do not need to operate in a synchronized manner.

The open rear side 5 of the housing 3 forms a further opening 21 of the housing 3. If the powder nozzles 7 extend in each case through the further opening 21 as far as into the housing 3, the further opening 21 makes an air-conducting connection possible between the nozzle openings of the powder nozzles 7 and the surroundings 22 of the apparatus. The air-conducting connection is a free air flow path. If, alternatively, the nozzle openings of the powder nozzles 7 are situated above the further opening 21 and therefore outside the housing 3, the air-conducting connection between the powder nozzles 7 and the surroundings 22 of the housing exists anyway. In both cases, the air-conducting connection exists permanently, that is to say even in the case of outlet openings 13 which are closed completely by the actuating element 16 (FIG. 3).

Figure 4:
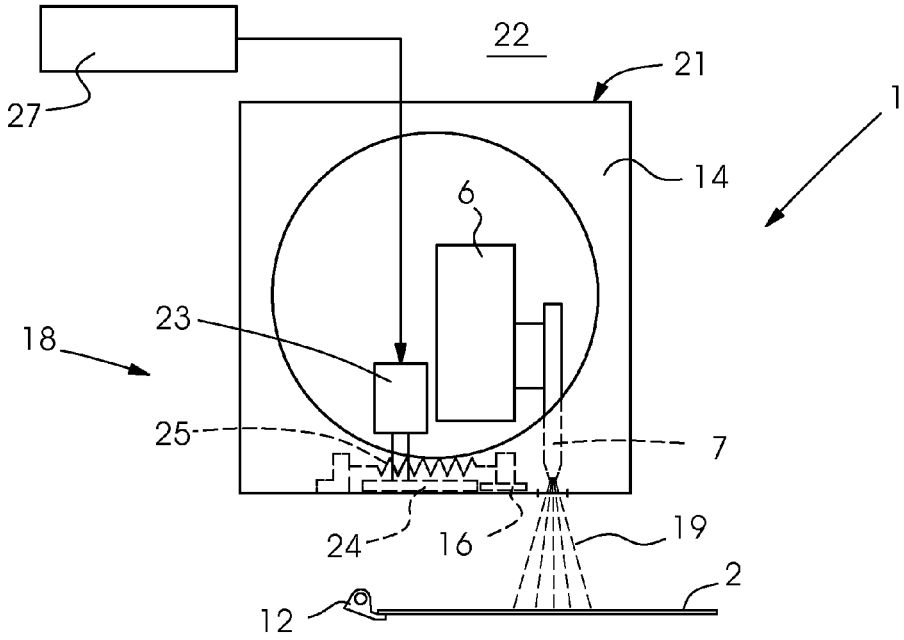
FIGS. 4 to 6 are illustrations showing a second exemplary embodiment having the actuating element which is moved to and fro via a cam mechanism.
Figure 5:
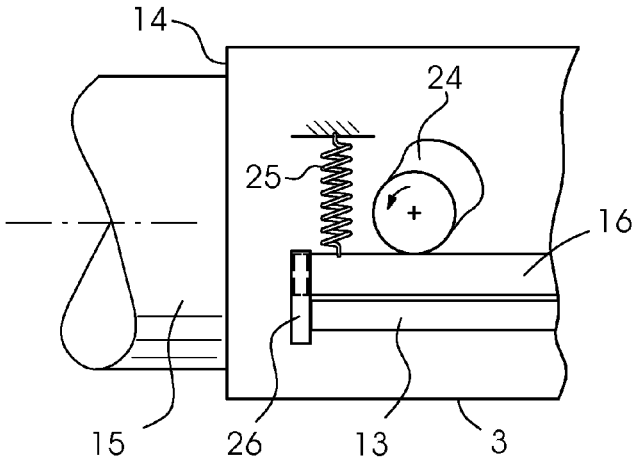
Figure 6:
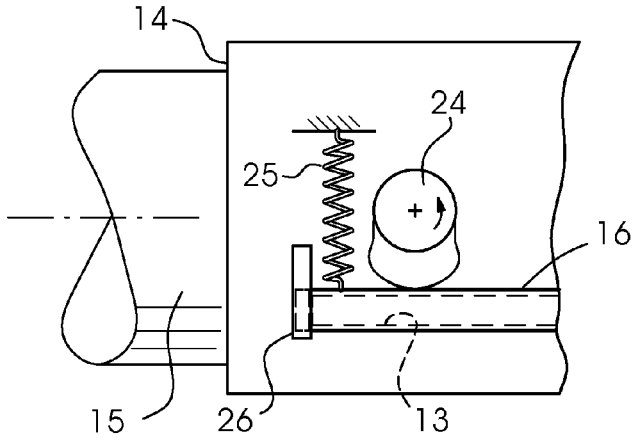

The exemplary embodiment which is shown in FIGS. 4 to 6 is a modification of the exemplary embodiment which is shown in FIGS. 1 to 3. In the exemplary embodiment according to FIGS. 4 to 6, the row of outlet openings is replaced by a single, continuous outlet opening 13 which extends over the entire sheet width in an uninterrupted manner. The entire spray device 6 including its powder nozzles 7 is arranged within the housing 3.

The drive device 18 contains a motor 23 which operates synchronously and displaces the actuating element 16 toward the outlet opening 13 via a rotatable control cam 24. After this, a restoring spring 25 pulls the actuating element 16 back again. The actuating element 16 is mounted at its two ends in, for example, rail-shaped guides 26 which guide the to and fro movement of the actuating element 16.

The actuating element 16 which can also be called a closure cover is formed from a light material, such as plastic or aluminum. A low mass moment of inertia and high dynamics are achieved as a result. The actuating element 16 is somewhat wider and longer than the outlet opening 13, in order to ensure sealed closure of the outlet opening 13. For example, the width of the outlet opening 13 can be five millimeters and the width of the actuating element can be seven millimeters here.

The motor 23 can be actuated by an electronic control device 27, by which the cycle/pause ratio (duty factor) of the to and fro movement of the actuating element 16 can be adapted to different format lengths of the printed sheets 2. The control device 27 can be used to set how long the actuating element 16 remains in the position (FIG. 6), in which it shuts the outlet opening 13. In the case of a large sheet format, the gaps 20 (FIG. 3) are small and accordingly the actuating element 16 is held in the closure position for a relatively short time and, in the case of a small sheet format, the gaps 20 are large and the actuating element 16 is held in an overlap with the outlet opening 13 for a relatively long time.

It is also the case in this exemplary embodiment that the powder nozzles 7 are not separated hermetically from the surroundings at any instant, because at all times the air-conducting connection between the powder nozzles 7 and the surroundings 22, for example the air volume in the printing room, exists through the opening 21. This air-conducting connection also exists when the outlet opening 13 is closed by the actuating element 16 (FIG. 6).

It goes without saying that the row of outlet openings of the exemplary embodiment of FIGS. 1 to 3 and the single outlet opening 13 of the exemplary embodiment of FIGS. 4 to 6 can be exchanged for one another.

Figure 7:
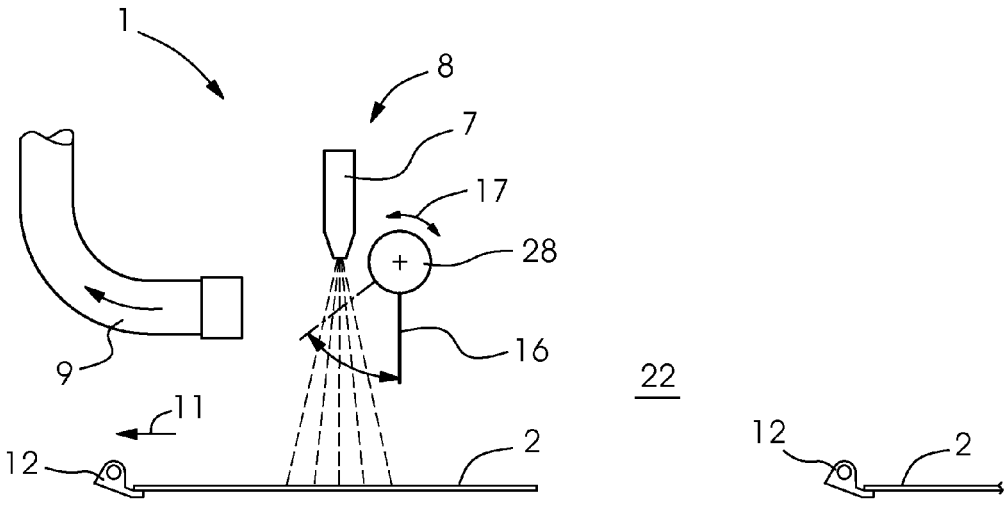
FIGS. 7 and 8 are illustrations showing a third exemplary embodiment having a deflection element for deflecting the powder air jet.
Figure 8:
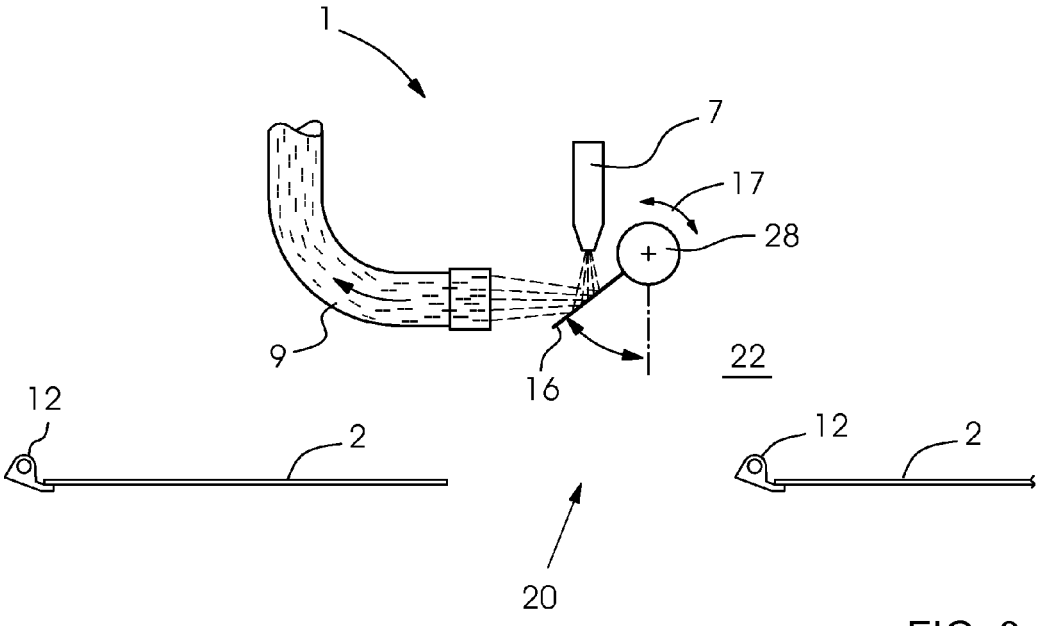

FIGS. 7 and 8 show a third exemplary embodiment, in which the housing is omitted. The actuating element 16 is mounted pivotably in a joint 28. The actuating element 16 can be pivoted alternately into a first position and into a second position by a drive device (not shown in the drawing) in a synchronized manner with the delivery of the printed sheets.

In the first position which is shown in FIG. 7, the powder air jets 19 which are ejected by the powder nozzles flow to the printed sheet 2 which is transported past, in a manner which is unimpeded by the actuating element 16. The actuating element 16 is withdrawn out of the jet path of the powder air jets 19, with the result that the powder jets 19 can flow past the actuating element 16.

In the second position which is shown in FIG. 8, the actuating element 16 is situated in the jet path or flow way of the powder air jets 19, for which reason the latter are deflected by the actuating element 16 toward the extraction device 9. Here, the actuating element 16 acts as a deflection element and assumes an acute angle with its impact face relative to the ejection direction of the powder nozzles 7. The angle can be 45 degrees if the powder nozzles 7 and the extraction device 9 are arranged with their directions of action offset at right angles relative to one another, as is shown in the drawing. In the drawing, the direction of action of the powder nozzles 16 is vertical and the direction of action of the extraction device 9 is horizontal. The actuating element 16 always assumes the second position when a gap 20 between two printed sheets 2 which follow one another is situated in the target area of the powder nozzles 7, that is to say in a position opposite the powder nozzles 7. In the second position, the powder air jets 19 which are ejected by the powder nozzles 7 fall onto the actuating element 16 which is oriented obliquely relative to the powder air jets 19 and, as a result, the powder air jets 19 are deflected into the opening or openings of the extraction device 9.

As viewed in the transport direction 11 of the printed sheets 2, the extraction device 9 is arranged behind the powder nozzles 7 and can have a single opening which extends, for example as an elongate hole or slit, over the entire nozzle row 8, or can have in each case one opening per powder nozzle 7. During printing operation, the extraction device 9 operates permanently with a constant suction force which prevails at the opening or the openings of the extraction device 9 both when the actuating element 16 is situated in the first position and when the actuating element 16 is situated in the second position. The suction force or suction power is selected and can be set in such a way that, during dusting of the printed sheet 2 (FIG. 7), the powder air jets 19 are not impaired and are not deflected by the vacuum of the extraction device 9, and that effective extraction substantially of the entire deflected powder amount is ensured when the actuating element is situated in the second position (FIG. 8). When the actuating element 16 is situated in the second position, the spacing is sufficiently large between the impact face of the actuating element 16 and the nozzle openings of the powder nozzles 7 directed at the impact face in order to avoid a back pressure which feeds back into the powder nozzles 7.

An air-conducting connection exists permanently between the powder nozzles 7 or their nozzle openings on one side and the surroundings 22 of the apparatus on the other side, which apparatus is configured as what is known as an open system; an exchange of air or air pressure equalization is always possible between them. As a result of the unimpeded air pressure equalization, a precaution is likewise made with regard to the avoidance of feedback and pressure surges via the powder nozzles 7 into the dusting system.

The invention claimed is:

1. An apparatus for dusting printed sheets with powder, the apparatus comprising:

at least one powder nozzle;

an actuating element mounted such that said actuating element can be adjusted into a position, in which said actuating element is situated in a jet path of said powder nozzle and the powder bounces off said actuating element;

an extraction device for extracting the powder bouncing off said actuating element; and an air-conducting connection existing permanently between said powder nozzle and surroundings of the apparatus; and a housing having at least one outlet opening formed therein and a closure element for closing said outlet opening, said actuating element being formed by said closure element, and in that, if said outlet opening is not closed, said powder nozzle sprays the powder through said outlet opening and, if said outlet opening is closed, said air-conducting connection exists between said powder nozzle and the surroundings of the apparatus, said powder nozzle being one of a plurality of powder nozzles disposed in a nozzle row, said closure element being a common closure element extending over all of said powder nozzles of said nozzle row.

2. The apparatus according to claim 1, wherein said housing has a further opening formed therein, through which said air-conducting connection exists between said powder nozzle and the surroundings of the apparatus.

3. The apparatus according to claim 2, wherein said outlet opening is situated on a front side of said housing, said front side facing the printed sheets to be dusted, and said further opening is situated on a rear side of said housing.

4. The apparatus according to claim 1, wherein said housing has a side wall with an opening formed therein for said extraction device.

5. The apparatus according to claim 1, further comprising a deflection element for deflecting a powder jet ejected out of said powder nozzle toward said extraction device, said actuating element being formed by said deflection element.

6. The apparatus according to claim 5, wherein said extraction device sucks continuously with a suction force during a printing operation.

7. The apparatus according to claim 6, wherein the suction force is firstly so strong that the powder which is deflected when said deflection element is situated in a closed position is sucked in by said extraction device, and secondly is so weak that the powder jet which is sprayed to the printed sheet to be dusted when said deflection element is situated out of an open position is scarcely deflected in a transverse direction by said extraction device.

8. A printing press, comprising:

an apparatus for dusting printed sheets with powder, said apparatus containing:

at least one powder nozzle;

an actuating element mounted such that said actuating element can be adjusted into a position, in which said actuating element is situated in a jet path of said powder nozzle and the powder bounces off said actuating element;

an extraction device for extracting the powder bouncing off said actuating element; and an air-conducting connection existing permanently between said powder nozzle and surroundings of the apparatus; and a housing having at least one outlet opening formed therein and a closure element for closing said outlet opening, said actuating element being formed by said closure element, and in that, if said outlet opening is not closed, said powder nozzle sprays the powder through said outlet opening and, if said outlet opening is closed, said air-conducting connection exists between said powder nozzle and the surroundings of the apparatus, said powder nozzle being one of a plurality of powder nozzles disposed in a nozzle row, and said closure element being a common closure element which extends over all of said powder nozzles of said nozzle row.

* * * * *